US005153567A

United States Patent [19]

Chimento

[11] Patent Number: 5,153,567

[45] Date of Patent: Oct. 6, 1992

[54] ALARM KIT APPARATUS

[76] Inventor: Samuel V. Chimento, 667 Country Club Dr., Ste. 1221, Simi Valley, Calif. 93065

[21] Appl. No.: 723,820

[22] Filed: Jul. 1, 1991

[51] Int. Cl.[5] ..... G08B 17/10

[52] U.S. Cl. ..... 340/691; 169/23; 169/51; 340/568; 340/628; 340/693

[58] Field of Search ..... 340/568, 693, 628, 691; 169/23, 51

[56] References Cited

U.S. PATENT DOCUMENTS 4,283,657 8/1981 Gordon et al. ..... 340/628
4,418,336 11/1983 Taylor ..... 169/51
4,532,996 8/1985 Wilson et al. ..... 169/23
4,548,274 10/1985 Simpson ..... 169/51
4,592,301 6/1986 Monte ..... 169/23
4,598,893 7/1986 Stobbart ..... 169/51
4,649,376 3/1987 Frank ..... 340/691
4,805,701 2/1989 Mountford ..... 169/23

*Primary Examiner*—Glen R. Swann, III
*Attorney, Agent, or Firm*—Leon Gilden

[57] ABSTRACT

A mounting plate secures a fire extinguisher canister within a releasable securement strap, wherein the securement strap further includes a flashlight member released upon releasing of the fire extinguisher canister. An audible alarm is cooperative with a flashing light to direct a visual and audible signal in association with a smoke detector circuitry of a dwelling.

5 Claims, 4 Drawing Sheets 2
14
12
13
10
11
20
17
24a
24b
24
20
23
19
25
22
26
2

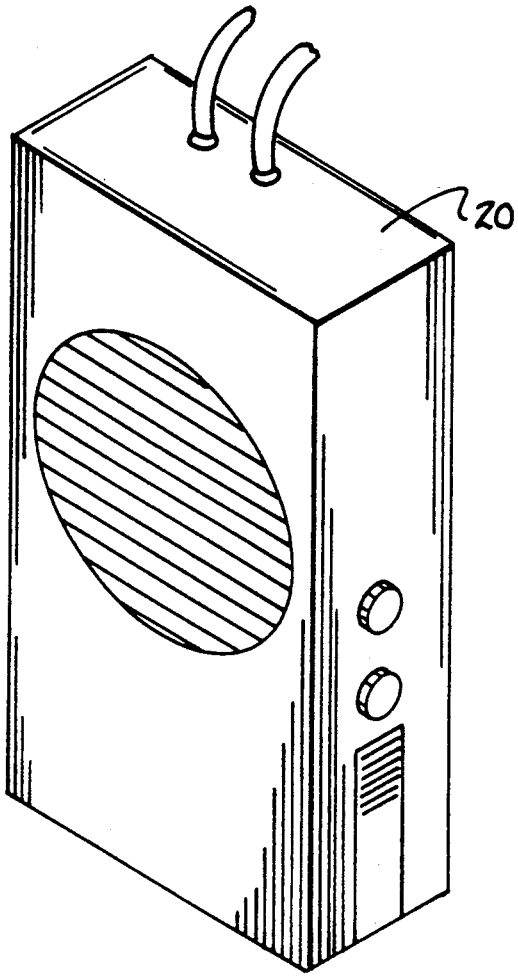
FIG 3
FIG 4
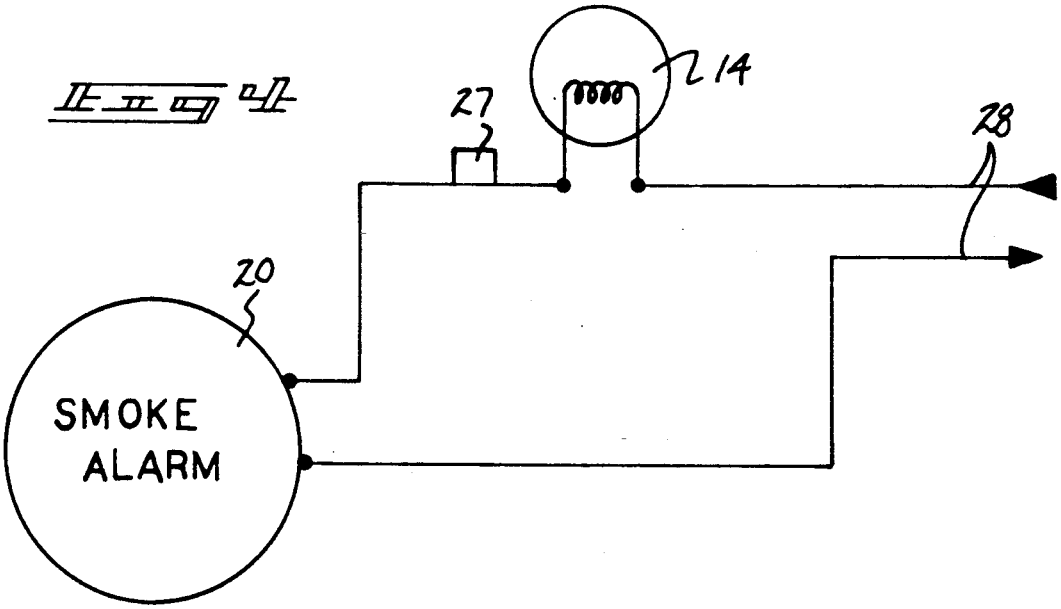

ALARM KIT APPARATUS

BACKGROUND OF THE INVENTION

1. Field of the invention

The field of invention relates to fire alarm apparatus, and more particularly pertains to a new and improved alarm kit apparatus for use in cooperation with fire alarm circuitry of an associated dwelling.

2. Description of the Prior Art

Various fire alarm devices are utilized in the prior art in accommodating various situations dealing with a fire situations. An example is set forth in U.S. Pat. No. 4,805,701 to Mountford wherein a fire extinguisher mounts a fire alarm thereon.

U.S. Pat. No. 4,592,301 to Monte sets forth a fire extinguisher support mechanism that includes an audible alarm.

U.S. Pat. No. 4,418,336 to Taylor sets forth an alarm organization when a fire extinguisher is removed from an associated mount structure.

U.S. Pat. No. 4,532,996 to Wilson, et al. sets forth an alarm system utilizing an acoustic alarm arrangement.

As such, it may be appreciated that there continues to be a need for a new and improved alarm kit apparatus as set forth by the instant invention addresses both the problems of ease of use as well as effectiveness in construction in providing a kit construction for accommodating a fire situation by an individual and in this respect, the present invention substantially fulfills this need.

SUMMARY OF THE INVENTION

The present invention provides an alarm kit apparatus wherein the same sets forth an organization utilizing an audible alarm and illumination unit to direct an individual to an associated fire extinguisher and associated portable flashlight mounted thereon. As such, the general purpose of the present invention, which will be described subsequently in greater detail, is to provide a new and improved alarm kit apparatus which has all the advantages of the prior art fire alarm apparatus and none of the disadvantages.

To attain this, the present invention provides a mounting plate securing a fire extinguisher canister within a releasable securement strap, wherein the securement strap further includes a flashlight member released upon releasing of the fire extinguisher canister. An audible alarm is cooperative with a flashing light to direct a visual and audible signal in association with a smoke detector circuitry of a dwelling.

My invention resides not in any one of these features per se, but rather in the particular combination of all of them herein disclosed and claimed and it is distinguished from the prior art in this particular combination of all its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved alarm kit apparatus which has all the advantages of the prior art fire alarm apparatus and none of the disadvantages.

It is another object of the present invention to provide a new and improved alarm kit apparatus which may be easily and efficiently manufactured and marketed.

It is a further object of the present invention to provide a new and improved alarm kit apparatus which is of a durable and reliable construction.

An even further object of the present invention is to provide a new and improved alarm kit apparatus which is susceptible of a low cost of manufacture with regard to both materials and labor, and which accordingly is then susceptible of low prices of sale to the consuming public, thereby making such alarm kit apparatus economically available to the buying public.

Still yet another object of the present invention is to provide a new and improved alarm kit apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the audible alarm utilized by the instant invention.

FIG. 4 is a diagrammatic illustration of the alarm structure in association with a fire alarm circuitry of a dwelling.

DESCRIPTION OF THE PREFERRED EMBODIMENT

Figure 1:
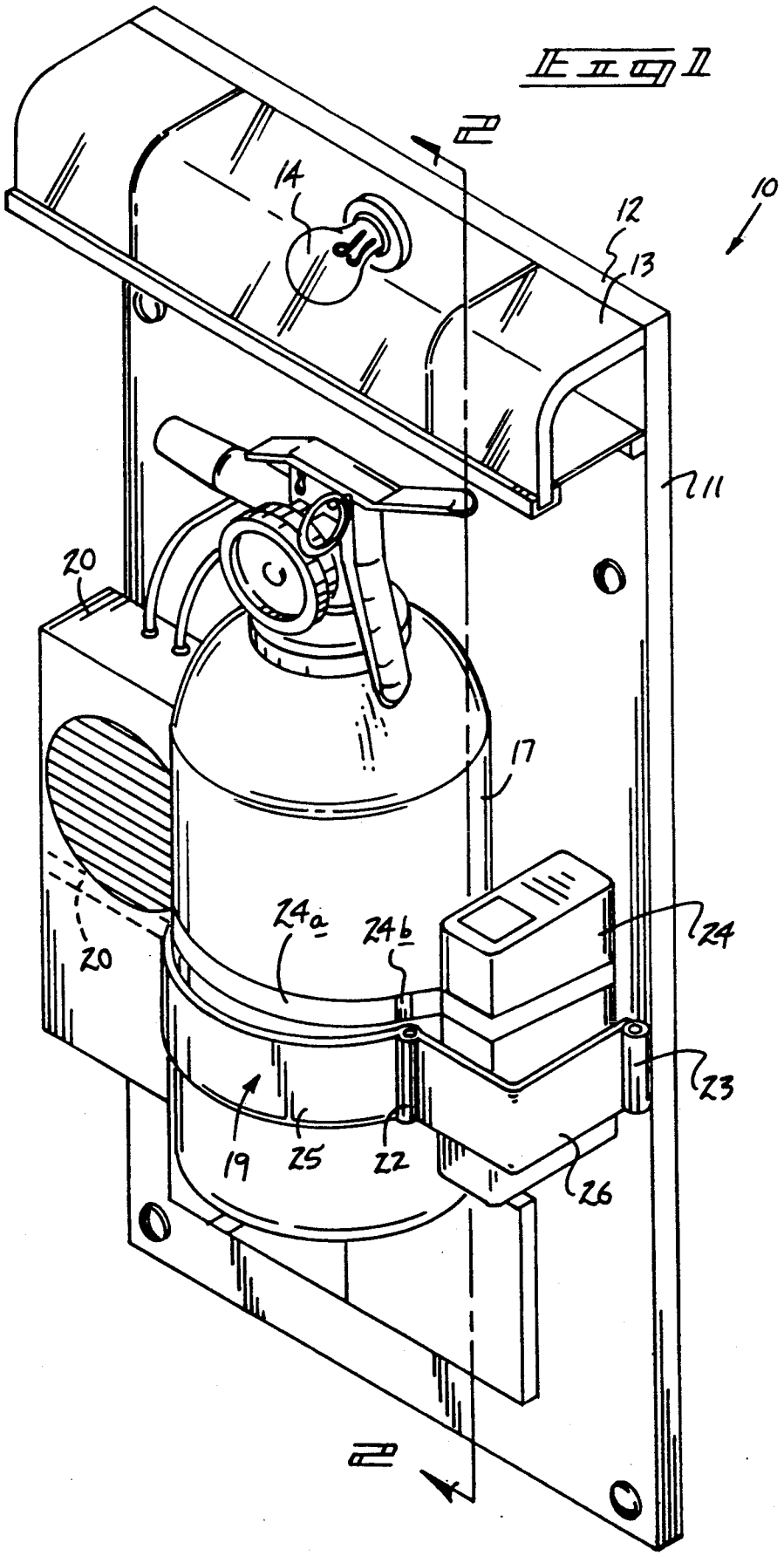
FIG. 1 is an isometric illustration of the instant invention.
Figure 2:
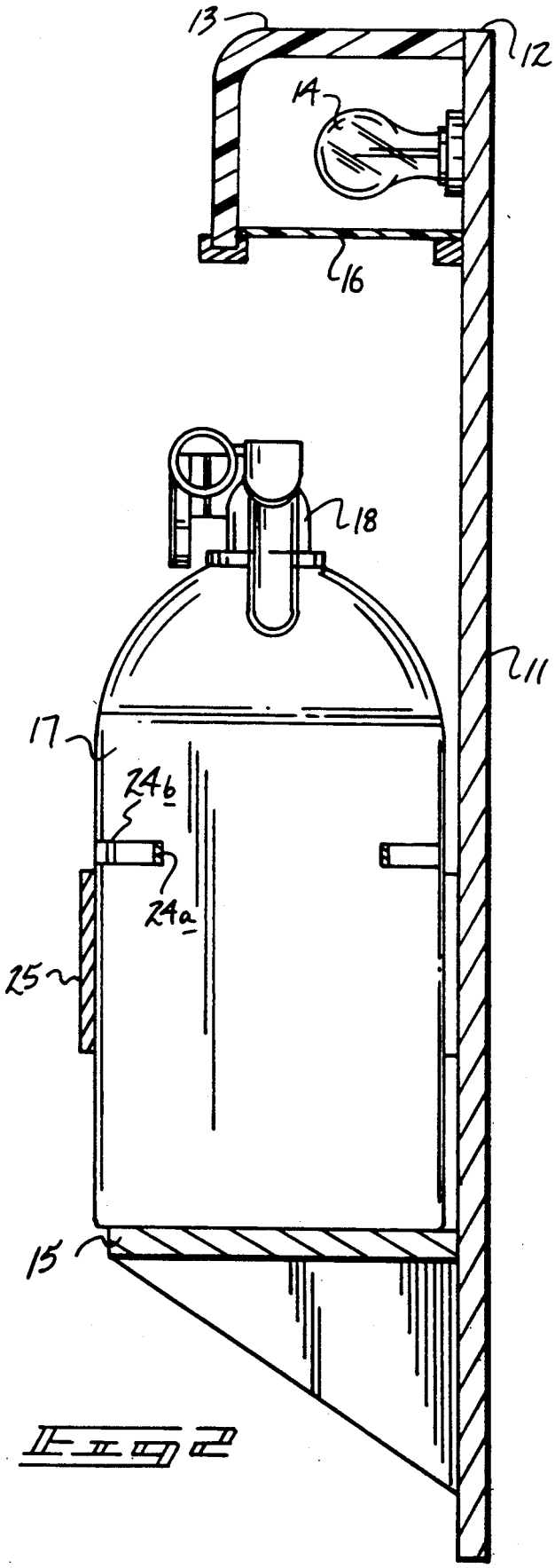
FIG. 2 is an orthographic view, taken along the lines 2—2 of FIG. 1 in the direction indicated by the arrows.

With reference now to the drawings, a new and improved alarm kit apparatus embodying the principles and concepts of the present invention and generally designated by the reference numeral 10 will be described.

Figure 5:
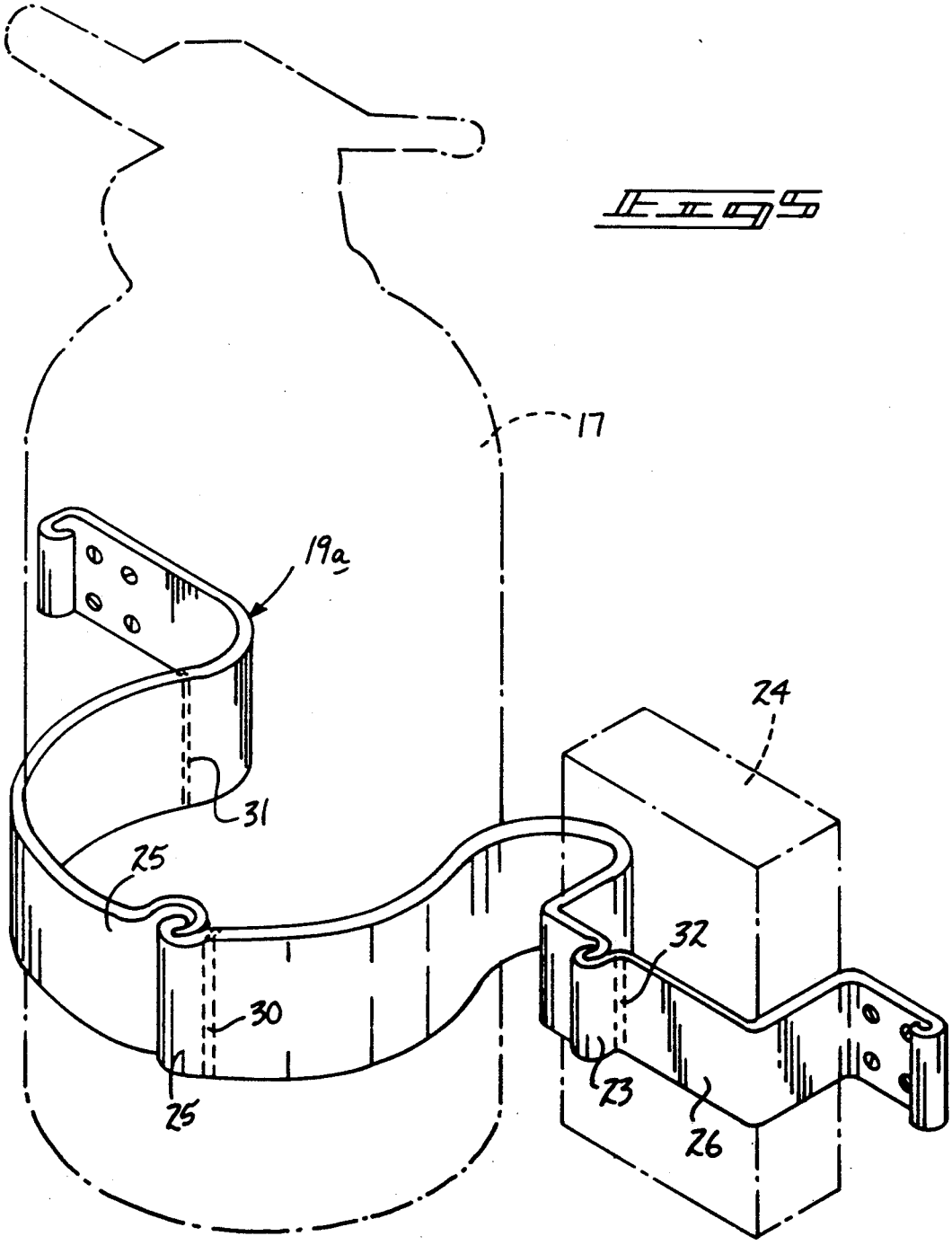
FIG. 5 is an isometric illustration of a modified strap construction utilized by the instant invention.

More specifically, the alarm kit apparatus 10 of the instant invention essentially comprises a mounting plate 11, including a planar forward surface formed with a top edge, wherein the top edge includes a translucent canopy 13 projecting orthogonally and beyond the planar forward surface, including a flasher light 14 positioned within the canopy 13. The translucent canopy 13 is typically of a red configuration to indicate alarm. A clear transparent lens 16 is positioned below the flashing light 14 communicating the translucent canopy 13 with the planar forward surface to provide illumination of the components of the alarm kit apparatus 10. A support shelf 15 is positioned in a spaced relationship relative to the top edge 12 adjacent a lower edge of the mounting plate, wherein the support shelf 15 supports a fire extinguisher canister 17 thereon. The fire extinguisher canister 17 includes a neck projection 18 extending coaxially and above the canister 17 for manual grasping of the neck projection in removal of the canister from the support shelf 15. A serpentine securement strap 19 includes an arcuate strap portion 25 circumferentially extending about a portion of the canister 17, wherein the arcuate strap portion includes a first strap hinge 22. A second strap hinge 23 is mounted adjacent a flashlight member 24, for use in a manner to be discussed in more detail below. An audible alarm 20 is in electrical communication with the fire alarm electrical circuitry 28, as depicted in FIG. 4, to effect electrical energy to the associated audible alarm 20 mounted to the planar forward surface 12 adjacent the canister 17. It should be noted that the electrical energy may be from a battery power pack or may be from an electrical communication with circuitry of an associated dwelling, as required or deemed convenient. The flashlight member 24 utilizes rechargeable batteries to maintain its continuous use. A flashlight strap **24*a* fixedly and securedly mounts a flashlight to the canister 17 and aligns the illumination from the flashlight towards the upper end or nozzle structure of the canister 17. A frangible connection 24*b* permits breakage of the strap 24*a* permitting removal of the flashlight 24 as required by use of an individual. In a like manner, the alarm 20 may optionally be mounted to the canister 17 or to the mounting plate 11, wherein mounting the the carrier 17 permits transport of the alarm to provide audible indication and orientation of an individual transporting the canister in use. Further it should be noted that a flasher unit 27 is in electrical association with the flashing light 14 to effect integral flashing of the light member 14. A first frangible strap connection 30 is positioned adjacent the first strap hinge 22, with a second frangible strap connection 31 positioned substantially diametrically opposed to the first frangible strap connection about the arcuate strap member 25 (FIG. 5). In this manner, grasping of the neck projection 18 ensures removal of the arcuate strap member 25 between the first and second frangible connections 30 and 31 respectively to ensure removal of the canister relative to the planar forward surface of the mounting plate 11. A third frangible strap connection 32 is provided adjacent the second strap hinge 23 to ensure release of the "L" shaped strap member 26 for access to the flashlight member 24**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An alarm kit apparatus, comprising, a mounting plate, the mounting plate including a planar forward surface, the planar forward surface including a top edge spaced above a bottom edge, the top edge including a translucent tinted canopy of a predetermined coloration positioned forwardly of the planar forward surface extending from the top edge and oriented orthogonally relative to the planar forward surface, and a flasher light mounted between the planar forward surface and the translucent canopy within the translucent canopy, and a clear transparent lens positioned below the flashing light, with the clear transparent lens mounted coextensively of the translucent canopy, and a support shelf orthogonally mounted to the planar forward surface below the translucent canopy, and the support shelf including a fire extinguisher canister mounted thereon, the fire extinguisher canister including a neck projection extending above the fire extinguisher canister intergrally associated therewith, and an audible smoke alarm fixedly mounted to the planar forward surface of the mounting plate, the audible alarm including flasher control means for effecting flashing of the flasher light upon activation of the audible smoke alarm, and a flashlight member, and a securement strap means for securement of the fire extinguisher canister and the flashlight member to the planar forward surface.

2. An apparatus as set forth in claim 1 wherein the securement strap includes an arcuate strap portion circumferentially extending about a portion of the fire extinguisher canister, and an "L" shaped strap member mounted about the flashlight member, and a first strap hinge mounted within the arcuate strap portion, and a second strap hinge mounted within the "L" shaped strap member to permit selective removal of the canister and the flashlight member relative to the planar forward surface.

3. An apparatus as set forth in claim 2 wherein the arcuate strap member includes a first frangible strap connection mounted adjacent the first strap hinge, and a second frangible strap connection arranged substantially diametrically opposed to the first frangible strap connection within the arcuate strap member to permit selective removal of the arcuate strap portion about the fire extinguisher canister permitting manual displacement of the fire extinguisher canister relative to the planar forward surface.

4. An apparatus as set forth in claim 3 including a third frangible strap connection positioned adjacent the second strap hinge within the "L" shaped strap member to permit selective removal of the "L" shaped strap member about the flashlight member.

5. An apparatus as set forth in claim 4 including a further securement strap mounted in surrounding relationship relative to the fire extinguisher canister and the flashlight member to secure the flashlight member to the fire extinguisher canister, wherein the further securement strap includes a frangible connection to permit selective removal of the flashlight member relative to the canister in use.

* * * * *